United States Patent [19]

Parsons

[11] Patent Number: 4,838,220

[45] Date of Patent: Jun. 13, 1989

[54] ROTARY VALVES

[75] Inventor: Bryan N. V. Parsons, Stoney Stanton, England

[73] Assignee: Jaguar Cars Limited, United Kingdom

[21] Appl. No.: 176,633

[22] Filed: Apr. 1, 1988

[30] Foreign Application Priority Data

Apr. 3, 1987 [GB] United Kingdom ..... 8708037

[51] Int. Cl.[4] ..... F01L 7/00

[52] U.S. Cl. ..... 123/190 D

[58] Field of Search ..... 123/190 R, 190 D

[56] References Cited

U.S. PATENT DOCUMENTS

| | | | |
|---|---|---|---|
| 1,799,759 | 4/1931 | McDowell | 123/190 D |
| 2,457,206 | 12/1948 | Carlson | 123/190 D |
| 3,274,901 | 9/1966 | Yost | 123/190 D |
| 4,418,658 | 12/1983 | DiRoss | 123/190 D |
| 4,517,937 | 5/1985 | Ball | 123/190 D |

FOREIGN PATENT DOCUMENTS

| | | |
|---|---|---|
| 427048 | 5/1912 | France . |
| 158269 | 1/1921 | United Kingdom . |
| 253213 | 2/1925 | United Kingdom . |
| 559830 | 1/1943 | United Kingdom . |
| 687298 | 5/1951 | United Kingdom . |
| 691275 | 5/1953 | United Kingdom . |
| 725088 | 7/1953 | United Kingdom . |
| 899724 | 9/1959 | United Kingdom . |
| 900594 | 1/1960 | United Kingdom . |
| 1162053 | 8/1967 | United Kingdom . |
| 2074236 | 4/1981 | United Kingdom . |

*Primary Examiner*—E. Rollins Cross

*Attorney, Agent, or Firm*—Davis, Bujold & Streck

[57] ABSTRACT

A rotary valve has a valve rotor with an angular discontinuity, the valve rotor being mounted for rotation relative to a port, so that as it rotates the rotor will open and close the port; a drive train is provided to rotate the rotor, said train being arranged to reduce the speed of the rotor so that it is stationary or near stationary when the port is closed; the port is surrounded by a seating area and the valve rotor is arranged to move into engagement with the seating area and close the port as the speed of the rotor is reduced and move away from the seating area as the speed of the rotor increases.

10 Claims, 2 Drawing Sheets

ROTARY VALVES

BACKGROUND OF THE INVENTION

The present invention relates to rotary valves and in particular rotary valves suitable for internal combustion engines.

It has been proposed hitherto to use rotary valves for internal combustion engines, but in order to seal the rotating valve member on the high pressure (ie compression and combustion) strokes of the engine, complex gas seals have been required. Furthermore, such systems result in high frictional loads with consequent reduction in efficiency and high wear rates. In order to reduce the problems of high frictional loads, it has been proposed to reduce the speed of rotation of the valves on the high pressure strokes of the engine, using a differential drive gear arrangement.

SUMMARY OF THE INVENTION

According to one aspect of the present invention a rotary valve comprises a valve rotor having an annular discontinuity, the valve rotor being mounted for rotation relative to a port so that as it rotates, the discontinuity will open and close the port, drive means being provided to rotate the rotor, said drive means including means to reduce the speed of the rotor when the port is closed, the port being surrounded by a seating area and means being provided to move the rotor so that it engages the seating area and closes the port, when the speed of the rotor is reduced; and move the rotor away from the seating area when the speed of the rotor is increased.

Preferably the speed of the rotor is reduced until it is stationary or near stationary when the port is closed, so that wear between the seating area and the rotor will be minimised. This may be achieved as disclosed in; British Patent Application No. 8708037, in which the drive is transmitted by means of a gear train, the drive gear having teeth over only a portion of its periphery, so that it will only mesh with and drive the driven gear which is connected to the valve rotor over a portion of each revolution of the drive gear, interlock means being provided to keep the driven gear and valve rotor stationary when out of mesh with the drive gear; or British Patent Application No. 8720494 in which a linkage mechanism is used to provide a varying speed drive which is reduced to almost stationary while the port is closed.

According to a preferred embodiment of the invention, the change in mementum of the valve rotor as it slows down and speeds up is used to move the rotor into engagement with the seating area or away from the seating area respectively. Alternatively, separate means, for example a cam formation may be used to move the valve rotor axially. According to a further alternative, the valve rotor may be resiliently biased away from the seating area and arranged such that when the port is closed, increase in pressure in the cylinder will move the valve rotor into engagement with the seating area.

BRIEF DESCRIPTION OF DRAWINGS

Various embodiments of the invention are now described, by way of example only, with reference to the accompanying drawings, in which.

DESCRIPTION OF PREFERRED EMBODIMENTS

Figure 1:
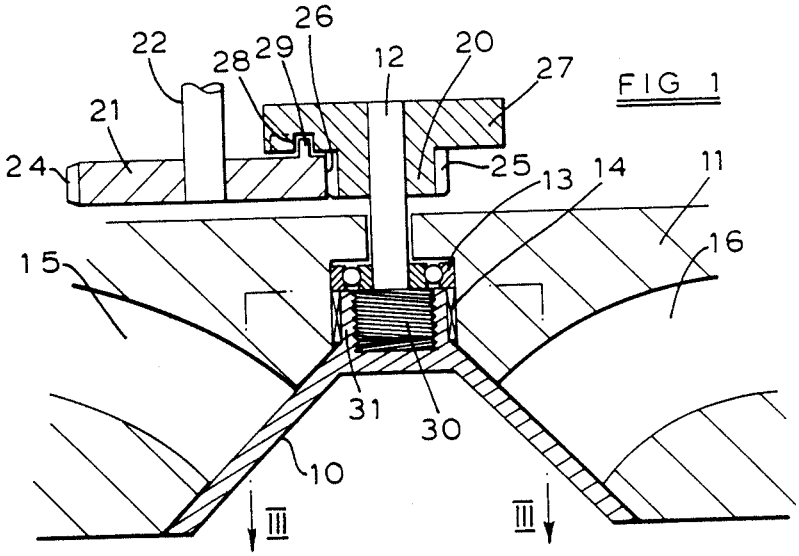
FIG. 1 illustrates in sectional side elevation a rotary valve according to the present invention.
Figure 2:
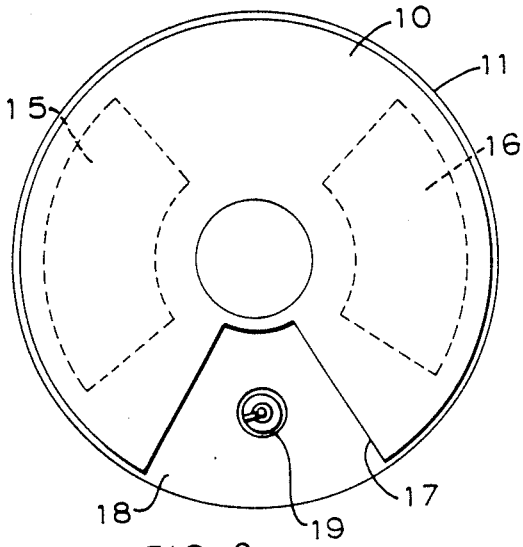
FIG. 2 illustrates in plan from below, the valve rotor of the rotary valve illustrated in FIG. 1.
Figure 3:
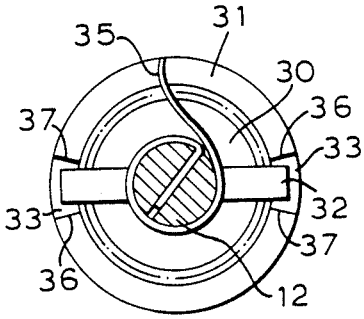
FIG. 3 is a section on enlarged scale along the line III—III of FIG. 1.

As illustrated in FIGS. 1 to 3, a rotary valve mechanism for an internal combustion engine comprises a conical valve rotor 10 which is mounted for rotation in a conical cylinder head 11, on a shaft 12. The shaft 12 is mounted through a ball bearing 13 by which it is located axially while the valve rotor 10 is rotatably mounted in a recess 19 in the cylinder head 11, on roller bearing 14.

The conical rotor 10 overlies an exhaust port 15 and an inlet port 16 in the cylinder head 11. A segment 17 is removed from the rotor 10 so that as it rotates it will open and close the ports 15 and 16. The exhaust and inlet ports 15 and 16 are positioned so that there is a space 18 therebetween which is greater than the segment 17 removed from the disc 10. An ignition device 19 is located through the cylinder head 11 in the portion thereof defined by space 18.

A driven gear 20 is secured to shaft 12 on the outside of the cylinder head 11. The gear 20 meshes with the gear 21 which is mounted on a drive shaft 22 by which it is driven by the engine. The gear 21 is provided with teeth 24 around only part of its periphery, said teeth 24 meshing with teeth 25 on the gear 20. The number of teeth 24 on gear 21 is equal to the number of teeth 25 on gear 20, so that for one revolution of gear 21 the gear 20 and rotor 10 will also rotate by one revolution. Drive is however interrupted when teeth 24 on gear 21 move out of mesh with teeth 25 on gear 20, over the portion 26 of the periphery of gear 21 which is without teeth.

A flange formation 27 on gear 20 overlies the periphery of gear 21. An arcuate track 28 is provided on the flange formation 27 and a pin 29 mounted on gear 21 engages in this track 28 to prevent rotation of gear 20 and rotor 10, when the teeth 24 and 25 of gears 21 and 20 respectively, are out of mesh. The track 28 may be provided with lead in and exit portions which will, respectively, decelerate and accelerate the gear 20 and rotor 10, as described in British Patent Application No. 8708037.

The shaft 12 is connected to the rotor 10 by means of a multi-start helical thread 30 which engages in a correspondingly threaded recessed portion 31 of the rotor 10. The thread 30 is such that rotation of the shaft 12 when driven by the gear train 20, 21 will unscrew the thread. Rotation of the rotor 10 relative to the shaft 12 is restricted to a few degrees, by means of a key 32 which is mounted on the shaft 12 and engages in a pair of diametric slots 33 in the upper face of the recessed portion 31 of rotor 10, as illustrated in detail in FIG. 3. A light torsion of spring 35 acts between the shaft 12 and rotor 10 to bias the rotor 10 in the direction of rotation on shaft 12, when driven.

When the teeth 25 of gear 20 are out of mesh with the teeth 24 of gear 21 and the rotor 10 is at rest with the segment 17 overlying portion 18 of the cylinder head 11, the torsion spring 35 will ensure that the rotor 10 is screwed up on the thread 30 and will engage the cylinder head 11, to seal the ports 15 and 16. Upon acceleration of the shaft 12 from rest, as the teeth 24 come back into mesh with the teeth 25, rotation of the shaft 12 will first unscrew the thread 30 from the recessed portion 31 of rotor 10, thus causing the rotor 10 to move away from the cylinder head 11, shaft 12 being fixed axially by ball bearing 13. The shaft 12 will rotate relative to the rotor 10 against the bias of the spring 35. If the drive torque exceeds the spring load, then key 32 engages leading face 37 of the slots 33, thus restricting any change in phase between the shaft 12 and rotor 10. At a constant velocity, the torsion spring 35 will tend to seat the rotor 10 against the cylinder head 11, but drag therebetween will tend to unscrew the rotor 10 on thread 30 thus minimising any frictional engagement and wear between the rotor 10 and cylinder head 11. As the teeth 24 move out of mesh with teeth 25 and the shaft 12 and rotor 10 come to rest, the momentum of the rotor 10 will tend to screw the rotor 10 up onto the thread 20 so that the rotor 10 is moved into tight engagement with the cylinder head 11, where it is held by torsion spring 35.

Figure 4:
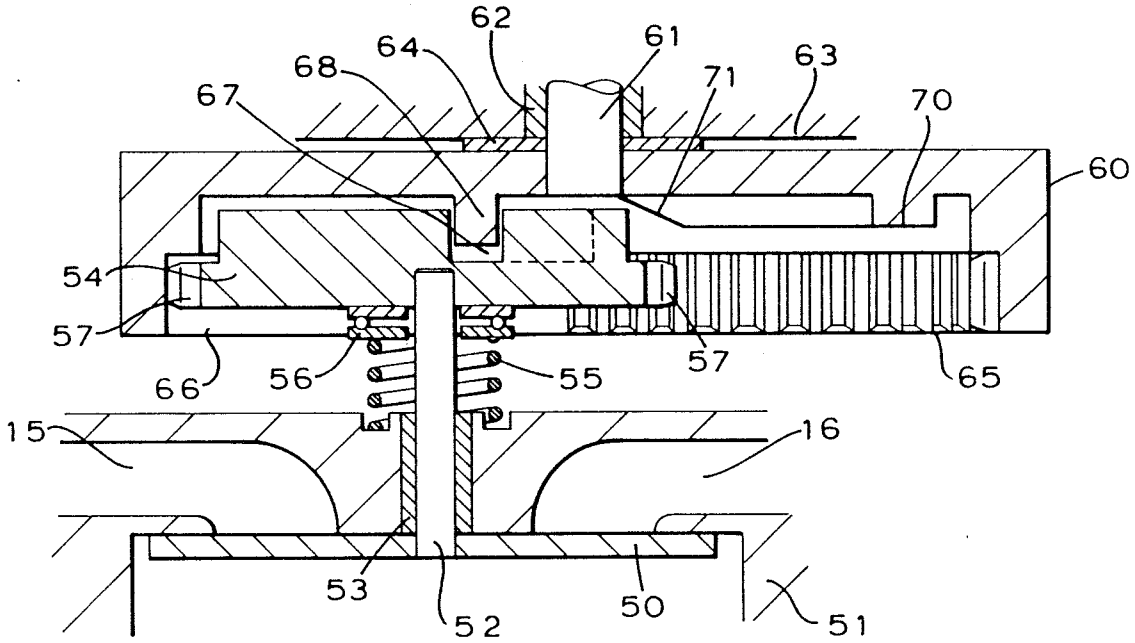
FIG. 4 illustrates in sectional side elevation an alternative form of rotary valve according to the present invention.

In the embodiment illustrated in FIG. 4 the valve rotor is in the form of a disc 50 which is mounted for rotation on a shaft 52 which passes through a cylindrical cylinder head 51. The disc 50 has a segment removed and overlies an exhaust port 15 and inlet port 16, arranged in similar manner to that illustrated in FIG. 2.

The shaft 52 is rotatably mounted through the cylinder head 51 in a plane bush 53, in which it is movable axially. A gear 54 is mounted on the end of shaft 52 outside the cylinder head 51 and is urged away from the cylinder head 51 by means of spring 55 which acts through a ball thrust bearing 56.

The gear 54 meshes with an internal gear 60 which is mounted on a shaft 61 which is rotatably supported in a bearing 62 through a support member 63. A thrust washer 64 is provided between the internal gear 60 and support member 63 to locate it axially. The shaft 61 is driven by the engine, in suitable manner.

The internal gear 60 is provided with teeth 65 about only a portion of its periphery, so that it will drive gear 54 and disc 50 intermittently, in similar manner to the gear train 20, 21 of the embodiment illustrated in FIG. 1. Also as with the embodiment illustrated in FIG. 1, the number of teeth 65 on gear 60 is equal to the number of teeth 57 on gear 54, so that for one revolution of gear 60, gear 54 will be rotated by one revolution, drive however being interrupted when the teeth 65 of gear 60 are out of mesh with teeth 57 of gear 54, over the portion 66 of the periphery of gear 60 which is without teeth.

An arcuate track 67 is provided in the upper face of gear 54 and a pin 68 mounted on the opposed face of gear 60 engages in the track 67 when the teeth 57 and 65 are out of mesh, to prevent rotation of gear 54.

An arcuate cam formation 70 with ramps 71 at either end, is provided on the face of gear 60 opposed to the upper face of gear 54. This arcuate cam formation 70 extends parallel to the periphery of gear 60 around the portion thereof with teeth 65, so that when the teeth 65 of gear 60 are in mesh with the teeth 57 of gear 54 and the disc 50 is being driven, the formation 70 will engage the upper face of gear 54 and move it downwardly, against the load applied thereto by the spring 55, so that the rotor 50 will be moved away from the cylinder head 51.

When the teeth 65 of gear 60 move out of mesh with the teeth 57 of gear 54 and the disc 50 stops rotating, the arcuate cam formation 70 ceases to engage the upper face of gear 54 and the spring 55 will force the gear upwardly until the disc 50 engages the cylinder head 51 and seals the ports 15 and 16.

The above embodiments thus provide rotary valve mechanisms in which the valve rotor is driven intermittently, the rotor being seated against the cylinder head to seal the ports when stationary and being lifted away from the cylinder head when rotating. The valve mechanisms consequently offer all the advantages of rotary valve mechanisms while providing positive seating which will produce sealing of the ports equivalent to that of poppet valves. Engagement of the valve rotor against the cylinder head will also assist in cooling of the rotor and help avoid pre-ignition problems.

Various modifications may be made without departing from the invention. For example while in the above embodiment only one dwell period is provided per revolution, more than one dwell period may be provided, the drive gear designed to provide multiple dwell points on each revolution. Although the valve rotors described above are in the form of a cone or disc with a single aperture, cones or discs with one or more apertures may be used.

I claim:

1. A rotary valve comprising a valve rotor having an annular discontinuity, the valve rotor being mounted for rotation relative to a port so that as it rotates, the discontinuity will open and close the port, drive means being provided to rotate the rotor, said drive means including means to reduce the speed of the rotor when the port is closed, the port being surrounded by a seating area and means being provided to move the rotor so that it engages the seating area and closes the port, when the speed of the rotor is reduced and move the rotor away from the seating area when the speed of the rotor is increased.

2. A rotary valve according to claim 1 in which the drive means will reduce the speed of the rotor so that it is substantially stationary when the port is closed.

3. A rotary valve according to claim 1 in which the valve rotor is mounted for rotation on a shaft, the rotor being mounted on the shaft by inter-engaging screw threaded formations, the screw threads being arranged such that rotation of the shaft, when driven, will unscrew the screw threads, means being provided to limit rotation of the rotar relative to the shaft.

4. A rotary valve according to claim 3 characterised in that the screw threaded formations (30,31) are in the form of multi-start helices.

5. A rotary valve according to claim 3 or 4 characterised in that a key (32) is secured to the shaft (12) and engages in a slot (33) in the rotor (10), the slot (33) being extended in the plane of rotation, to provide for limited rotation between the rotor (10) and shaft (12).

6. A rotary valve according to claim 3 characterised in that the rotor (10) is biased with respect to the shaft (12) in the direction of rotation of the shaft (12), when driven.

7. A rotary valve according to claim 3 characterised in that bearing means (13) is provided to axially restrain the shaft (12), while the valve rotor (10) is mounted so that it is free to move axially.

8. A rotary valve according to claim 7 in which the valve rotor is mounted on a shaft which passes through a bearing which will permit axial movement and rotation of the shaft, a first gear being drivingly connected to the shaft on the side of the bearing opposite to the rotor and spring means acting against said first gear to urge the rotor into engagement with the seating area, a second gear being drivingly connected to said first gear such that it will drive the first gear intermittently, said second gear having a cam formation which engages the first gear when it is being driven and moves the first gear axially against the load applied by the spring, to move the rotor away from the seating area.

9. A rotary valve according to claim 1 in which a cam surface is provided to move the valve rotor axially with respect to the seating area.

10. A rotary valve according to claim 9 in which spring means acts upon the valve rotor to maintain engagement with the cam surface.

* * * * *